United States Patent [19]

Maruki

[11] Patent Number: 4,686,821

[45] Date of Patent: Aug. 18, 1987

[54] YARN SPLICING APPARATUS WITH A YARN END UNTWISTING DEVICE

[75] Inventor: Hirosige Maruki, Kusatsu, Japan

[73] Assignee: Murata Kikai Kabushiki Kaisha, Kyoto, Japan

[21] Appl. No.: 850,540

[22] Filed: Apr. 9, 1986

[30] Foreign Application Priority Data

Apr. 11, 1985 [JP] Japan ..... 60-53908[U]

[51] Int. Cl.[4] ..... D01H 15/00

[52] U.S. Cl. ..... 57/22; 57/261

[58] Field of Search ..... 57/22, 261, 263, 401

[56] References Cited

U.S. PATENT DOCUMENTS

| | | | |
|---|---|---|---|
| 4,439,978 | 4/1984 | Mima | 57/261 X |
| 4,565,058 | 1/1986 | Rohner et al. | 57/261 X |
| 4,570,427 | 2/1986 | Premi et al. | 57/261 X |

*Primary Examiner*—Donald Watkins

*Attorney, Agent, or Firm*—Spensley Horn Jubas & Lubitz

[57] ABSTRACT

A yarn splicing apparatus including a yarn end untwisting device wherein ends of two yarns are untwisted and spliced by an action of fluid. An untwisting nozzle pipe of the untwisting device is mounted on a block independently and removably mounted on a yarn splicing body block having a yarn splicing hole.

9 Claims, 7 Drawing Figures

YARN SPLICING APPARATUS WITH A YARN END UNTWISTING DEVICE

FIELD OF THE INVENTION AND RELATED ART STATEMENT

This invention relates to a pneumatic yarn splicing apparatus having an untwisting device.

A yarn splicing apparatus which utilizes flows of air normally includes a yarn end untwisting device which untwists ends of two yarns to be spliced to bring fibers of the yarns into a parallel condition in order to produce a good joint of the yarns. A yarn end untwisting device disclosed in U.S. Pat. No. 4,439,978 includes a slidable untwisting nozzle pipe.

A yarn end untwisting nozzle which accomplishes a yarn end untwisting operation as described above essentially requires adjustment of such an untwisting nozzle pipe depending upon various conditions such as a yarn count of yarns to be spliced, length of fibers and a direction of twist of yarns. For example, while a jetting angle and an aimed position of compressed air to be jetted to yarns within an untwisting nozzle are adjusted finely in order that an end of a yarn untwisted by such an air jet may assume a form like an ear of a brush, actually an extent over which the pipe is slidably moved is so small that even a movement of the pipe by a distance of 1 mm or so may result in wide variations of untwisted condition. Accordingly, it is very troublesome for an operator to effect such a fine adjustment at a field such as a spinning mill where spinning frames and winders are installed, and precise adjustment is almost impossible.

OBJECT AND SUMMARY OF THE INVENTION

An object of the present invention is to provide a yarn splicing apparatus in which a yarn end untwisting device suitable for a yarn to be processed can be selected and set without the necessity of troublesome fine adjustment of untwisting nozzle pipes.

According to the present invention, of various members which constitute a yarn splicing apparatus, an untwisting nozzle pipe is mounted on a block which is independent of and removably mounted on a yarn splicing apparatus body block. A plurality of such nozzle blocks are prepared in advance in accordance with various conditions of several kinds of yarns, and one of the nozzle blocks which is suitable for a kind of yarns to be spliced is selected and securely mounted on the body block of the yarn splicing apparatus.

By simply mounting an untwisting nozzle block suitable for a kind of yarn on a body, the yarn splicing apparatus can serve as a yarn splicing apparatus with an adjusted yarn end untwisting device which can assure a good yarn splicing operation.

DETAILED DESCRIPTION OF PREFERRED EMBODIMENTS

Now, a preferred embodiment of the present invention will be described with reference to the accompanying drawings.

Figure 6:
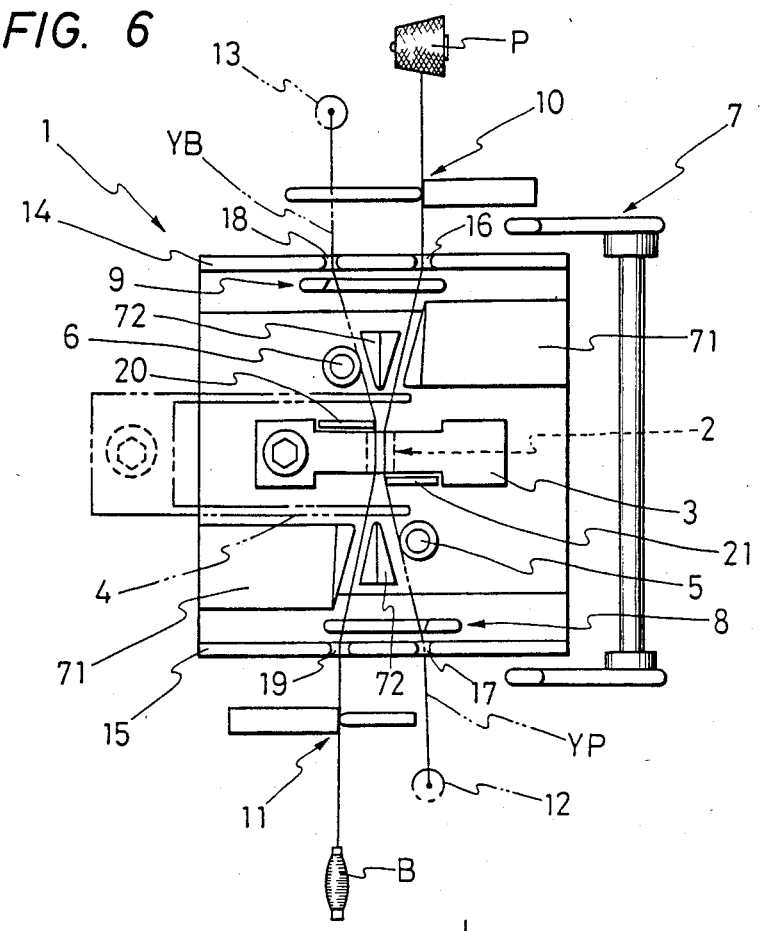
FIG. 6 a front elevational view showing general construction of an example of a yarn splicing apparatus.
Figure 7:
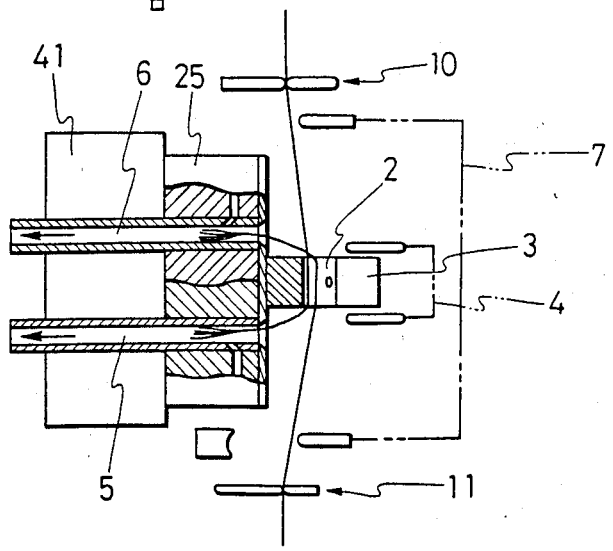
FIG. 7 a cross sectional side elevational view of the yarn splicing apparatus.

A general construction of a yarn splicing apparatus will first be described with reference to FIGS. 6 and 7. The yarn splicing apparatus denoted at 1 includes a yarn splicing member 3 in which a yarn splicing hole 2 is formed, a yarn pressing device 4, a pair of yarn end untwisting nozzles 5 and 6, a yarn handling lever 7, a pair of yarn cutting devices 8 and 9, a pair of yarn clamping devices 10 and 11, and so on.

A yarn splicing operation is effected in a following sequence. In particular, where the yarn splicing apparatus is provided for a known automatic winder, a yarn YP on the side of a package P is first sucked into and held by a known suction mouth 12, and then the suction mouth 12 is pivoted to introduce the yarn YP on the package side to a position forwardly of the yarn splicing apparatus so that part of the yarn YP on the package side is clamped by the clamping device 10. Meanwhile, the clamping device 11 is pivoted to introduce a yarn YB on the side of a spinning bobbin B to the clamping device 11 by which the yarn YB on the spinning bobbin side is then clamped. After then, the yarn handling lever 7 is pivoted to introduce and insert the yarn YP on the package side into guide slits 16 and 17 in a pair of guide plates 14 and 15, respectively, and also into the yarn splicing hole 2 while the other yarn YB is introduced and inserted into guide slits 18 and 19 in the guide plates 14 and 15, respectively, and also into the yarn splicing hole 2. As a result, the two yarns YP and YB are positioned in a condition as illustrated in FIG. 6. Subsequently, the yarn cutting devices 8 and 9 are operated to cut the respective yarns YP and YB at positions spaced a predetermined distance from the clamped positions of the yarns YP and YB, and end portions of the yarns thus cut are sucked into the yarn end untwisting nozzles 5 and 6 so that they are acted upon by an untwisting operation by flows of compressed air jetted into the nozzles 5 and 6 in order to put the yarn end portions to a condition facilitating subsequent splicing thereof. In particular, the yarn end portions are untwisted to cause fibers thereof to extend in parallel relationship as in a brush. In this instance, the yarn handling lever 7 assumes a position retracted away from the yarns, and the yarn ends are thus sucked to the interior of the yarn untwisting nozzles 5 and 6 as seen in FIG. 7.

After completion of such a yarn untwisting operation, the yarn handling lever 7 is pivoted over a large extent toward the yarns, thereby drawing out the yarn ends from within the yarn untwisting nozzles 5 and 6 and placing, together with an operation of the yarn pressing device 4, extremity portions of the yarn ends one on the other within the yarn splicing hole 2. As a result, the yarn ends are set in position with their untwisted portions put one on the other.

Then, by an action of flows of compressed air jetted into the yarn splicing hole 2, splicing of the yarns is effected in a manner as described above.

It is to be noted that a pair of controlling plates 20 and 21 are secured to the yarn splicing member 3 in such a manner that they cover part of openings at opposite ends of the yarn splicing hole 2 for controlling the position of yarns and flows of air which flow out from the opposite end openings of the yarn splicing hole 2.

Now, an untwisting nozzle block according to the present invention and a body block will be described with reference to FIGS. 1 to 5.

Figure 1:
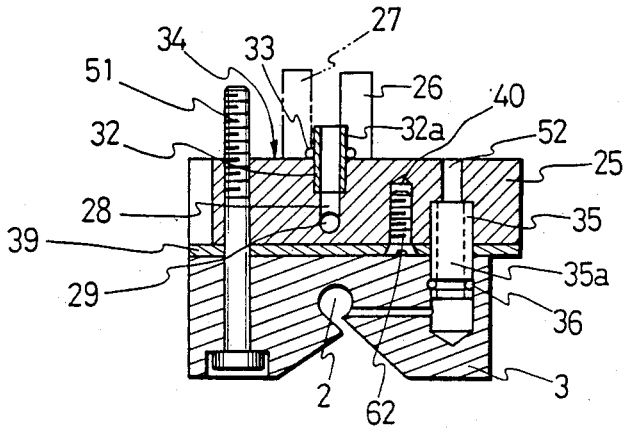
FIG. 1 is a cross sectional plan view showing a yarn splicing member and an untwisting nozzle block fastened to the yarn splicing member and taken along line I—I of FIG. 2.
Figure 2:
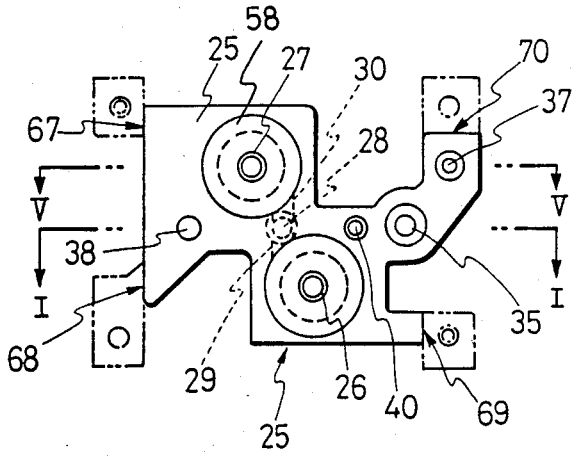
FIG. 2 a front elevational view of the untwisting nozzle block.

Referring first to FIGS. 1 and 2, a pair of untwisting nozzle pipes 26 and 27 are secured to an untwisting nozzle block 25 and is adjusted to a position suitable for a particular yarn. A main fluid path 28 for supplying compressed air to the pipes 26 and 27 and a pair of branch paths 29 and 30 branched from the main fluid path 28 are perforated in the untwisting nozzle block 25. A first thin pipe 32 is securely fitted in the main path 28 and connects the main path 28 to a compressed air supply path 31 (FIG. 4) of the body block. An O-ring 33 is fitted on the thin pipe 32, and part of the thin pipe 32 extends as at 32*a* from a rear face 34 of the block 25 to position the body block when the body block is coupled thereto.

Further, a second thin pipe 35 for supplying compressed air to the yarn splicing hole 2 of the yarn splicing member 3 is secured to and extends from a side of the untwisting nozzle block 25 opposite to the first thin pipe 32, that is, a front face of the block 25. An O-ring 36 is fitted also on the second thin pipe 35, and the extension 35*a* of the second thin pipe 35 acts to position the yarn splicing member 3 when the yarn splicing member 3 is coupled thereto.

A pair of through-holes 37 and 38 for passing therethrough bolts for securing the block 25 to the body block are formed in the block 25, and a threaded hole 40 for securing a front plate 39 is also formed in the block 25. The through-hole 38, the first thin pipe 32, a threaded hole 40 and the second thin pipe 35 are disposed along a straight line as seen in FIG. 2. The untwisting nozzle pipes 26 and 27 are located on opposite sides of the straight line, and thus the untwisting nozzle block 25 is formed compactly. It is to be noted that a pair of guide blocks 71 and 72 as shown in FIG. 6 are securely mounted on the front plate 39.

Figure 3:
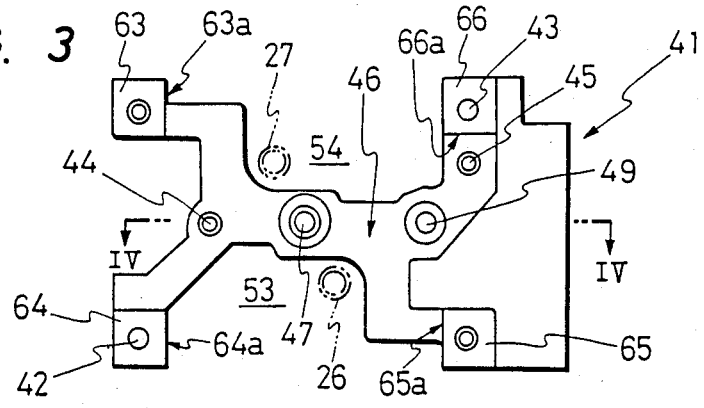
FIG. 3 a front elevational view of a body block.
Figure 4:
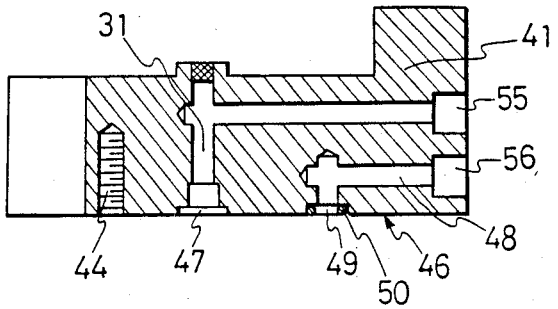
FIG. 4 a cross sectional view taken along line IV—IV of FIG. 2 showing the body block.

A body block 41 is shown in FIGS. 3 and 4. A pair of bolt passing holes 42 and 43 for passing therethrough bolts for securing the body block 41 to a winder body are perforated in the body block 41, and a threaded hole 44 for securing the untwisting nozzle block 25 is also formed in the body block 41. A coupling face 46 of the body block 41 at which the nozzle block 25 is coupled to the body block 41 is formed as a flat face, and the supply path 31 for supplying compressed air to the untwisting nozzle pipes 26 and 27 is opened at 47 to the coupling face 46 of the body block 41. Another supply path 48 for supplying compressed air to the yarn splicing hole 2 is also opened to the coupling face 46 of the body block 41, and an O-ring 50 is fitted in the opening 49 of the supply path 48. A threaded hole 44 is formed in the untwisting nozzle block 25, and a bolt 51 is screwed in the threaded hole 44 to fasten the yarn splicing member 3, the front plate 39 and the untwisting nozzle block 25 in integral relationship to the body block 41. Thus, when the body block 41 and the untwisting nozzle block 25 of FIGS. 1 and 4, respectively, are coupled to each other, the bolt 51, the extension 32*a* of the first thin pipe 32 and the opening 52 of the second thin pipe 35 of FIG. 1 are connected to the threaded hole 44, and the openings 47 and 49 of FIG. 4, respectively. It is to be noted that a pair of cut off spacings 53 and 54 of the body block 41 as seen in FIG. 3 are provided to accommodate the untwisting nozzle pipes 26 and 27 or a yarn cutting device or the like therein. Further, a pair of pipes not shown which connect to a compressed air supply source are connected to openings 55 and 56 of the compressed air supply paths 31 and 48 shown in FIG. 4 which are formed at a side face of the body block 41.

Figure 5:
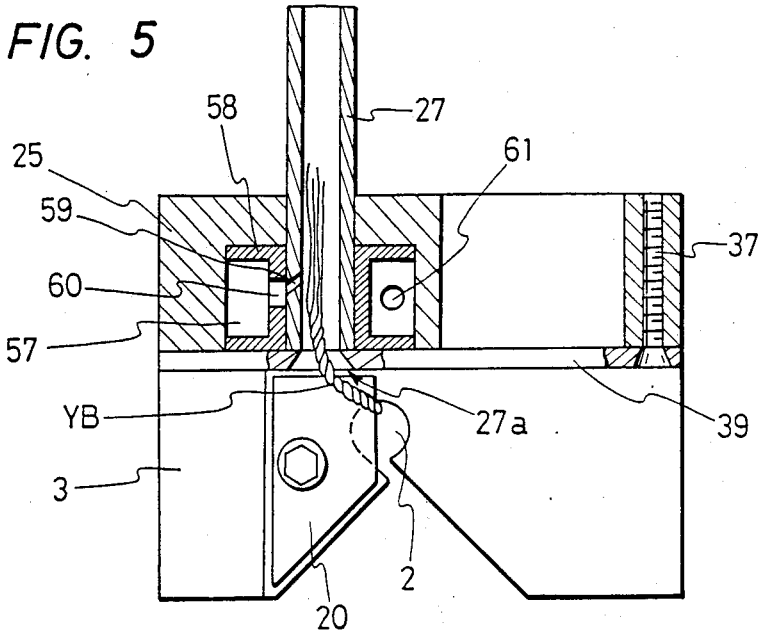
FIG. 5 a cross sectional view taken along line V—V of FIG. 2.

The untwisting nozzle pipe 27 is provided on the untwisting nozzle block 25 in such a manner as shown in FIG. 5. FIG. 5 is a cross sectional view taken along line V—V of FIG. 2 and illustrates a relationship of the untwisting nozzle pipe 27 and the untwisting nozzle block 25 to the yarn splicing member 3. In particular, a bush 58 is fitted in a cylindrical recess 57 formed in the nozzle block 25, and the untwisting nozzle pipe 27 is inserted in a center hole of the bush 58. A compressed air jetting hole 59 is formed obliquely toward the interior in the untwisting nozzle pipe 27 and is opened at an inner circumferential face of the pipe 27. The jetting hole 59 communicates with a compressed air passing hole 60 formed in the bush 58. Further, the compressed air supply branch path 30 for the untwisting nozzle shown in FIGS. 1 and 2 is opened as at 61 to part of the cylindrical recess 57 of the nozzle block 25 so that compressed air may be jetted toward the interior within the untwisting nozzle pipe 27 to untwist an end YB of a yarn.

The position of the opening 61 of the compressed air jetting hole 59 which is opened in the untwisting nozzle pipe 27, that is, the distance from an end face 27*a* for the yarn end sucking opening, the jetting direction of a compressed air jet, the inner diameter, number and shape of the jetting hole, and so on, must be appropriate for a yarn to be processed. For example, in the case of spun yarns wherein fibers have a long average length of 50 to 100 mm, the position of the opening 61 is selected such that compressed air from the jetting hole 59 may be jetted to an extremity portion of an end of a yarn sucked into the yarn splicing hole. On the other hand, in the case of spun yarns wherein fibers have a short average length of 30 to 50 mm, if compressed air is jetted to the position a little spaced from an extremity portion of an end of a yarn, then the yarn end may be untwisted into a form like an ear of a brush.

Thus, various untwisting nozzle blocks 25 are prepared in prior in each of which untwisting nozzle pipes 26 and 27 suitable for a yarn to be processed are securely inserted, and at a field in a plant or the like, a selective one of the nozzle blocks 25 is securely mounted on a body block 41 as shown in FIGS. 3 and 4 which is fixedly installed on a winder body. In this manner, a yarn splicing apparatus which is suitable for a yarn to be processed can be assembled without fine adjustment of untwisting nozzle pipes 26 and 27.

It is to be noted that there are two procedures for mounting an untwisting nozzle block 25 on a body block 41 as described below. In particular, the first procedure includes fastening the front plate 39 to the block 25 by means of a screw 62 as seen in FIG. 1, and fitting the yarn splicing member 3 on the second thin pipe 35*a* whereafter the untwisting nozzle block 25 is mounted together with the yarn splicing member 3 on the body block 41. In particular, the coupling face 34 of the nozzle block 25 is contacted with the coupling face 46 of the body block 41 as shown in FIG. 4. In this instance, the first thin pipe 32*a* is inserted into the hole 47 of the body block 41 to position the nozzle block 25 and the body block 41 relative to each other. Subsequently, the bolt 51 is screwed into the threaded hole 44, and another bolt not shown is screwed into the hole 37 of the nozzle block 25 and also into the threaded hole 45 of the body block 41, thereby completing the assembling operation. The second procedure includes first coupling to the body block 41 the untwisting nozzle block 25 on which the front plate 39 is securely mounted, and then only mounting the yarn splicing member 3 on the front plate 39. In either procedure, an untwisting nozzle block and a yarn splicing member suitable for a type of a yarn to be spliced are selectively combined with the body block 41, and thus an optimum yarn splicing apparatus can be obtained at a touch.

It is to be noted that, referring to FIG. 3, four portions 63, 64, 65 and 66 of the body block 41 project forwardly from the coupling face 46 of the body block 41 while side faces 63*a*, 64*a*, 65*a* and 66*a* serve as guide faces for side faces 67, 68, 69 and 70 of the nozzle block 25 so that the nozzle block 25 can be positioned very simply by the first thin plate 32 and the guide faces 63*a*, 64*a*, 65*a* and 66*a* of the body block 41. Accordingly, in a condition in which the nozzle block 25 is set as shown in FIG. 2, the bolt hole 38, the compressed air supply path, and so on, are automatically positioned, and hence the bolt 51 as shown in FIG. 1 can be simply screwed into the body block 41 through the yarn splicing member 3, the front plate 39 and the nozzle block 25.

As apparent from the foregoing description, according to the present invention, an untwisting nozzle block constituting a yarn splicing apparatus is formed independent of an apparatus body, and the preadjusted untwisting nozzle block is fastened to a body block by means of a screw. Only by such fastening of the preadjusted untwisting nozzle block, a yarn splicing apparatus suitable for a yarn to be processed can be set. Accordingly, at an operation field of a spinning mill or the like, an optimum yarn splicing apparatus can be set at a touch without the necessity of troublesome fine adjustment of untwisting nozzle pipes.

What is claimed is:

1. A yarn splicing apparatus comprising:

a yarn splicing member provided with a yarn splicing hole having a first compressed fluid jetting hole, yarn clamping devices disposed on opposing sides of the yarn splicing member, a yarn cutting device provided between the yarn splicing member and each of the yarn clamping devices, respectively, untwisting nozzle pipes for untwisting the cut yarn ends provided in an untwisting nozzle block to which the yarn splicing member is removably mounted, and a yarn splicing apparatus body block on which said untwisting nozzle block and said splicing nozzle member are mounted whereby said untwisting nozzle pipes may be removed from said yarn splicing apparatus independent of said yarn splicing member.

2. A yarn splicing apparatus as claimed in claim 1, wherein said untwisting nozzle block further comprises:

second compressed fluid jetting holes formed obliquely toward the interior in the untwisting nozzle pipe, a fluid path for supplying compressed fluid to the untwisting nozzle pipes, and a securing means for fitting the untwisting nozzle block to the yarn splicing member and the yarn splicing apparatus body block.

3. A yarm splicing apparatus as claimed in claim 2, wherein said securing means comprises a bolt and a through-hole formed in the untwisting nozzle block through which said bolt may be passed.

4. A yarn splicing apparatus as claimed in claim 2, wherein said untwisting nozzle pipe is inserted in a center hole of a bush which is fitted in a cylindical recess formed in the untwisting nozzle block and a compressed fluid passing hole which communicates with the second compressed fluid jetting hole is formed in the bush.

5. A yarn splicing apparatus as claimed in claim 2, wherein the position of said second compressed fluid jetting hole which is opened in the untwisting nozzle pipe, the jetting direction of a compressed fluid jet, the inner diameter, number and shape of the jetting hole are preselected based upon the characteristics of the yarn to be spliced.

6. A yarn splicing apparatus as claimed in claim 1, wherein said yarn splicing member and said untwisting nozzle block are mounted removably on the yarn splicing apparatus body block by means of bolts and bolt passing holes perforated in each of the yarn splicing member and untwisting nozzle block, and a plurality of projected portions are formed on said yarn splicing apparatus body block and the untwisting nozzle member, said projected portions serving as guide faces for the untwisting nozzle block so that the untwisting nozzle block can be positioned rigidly on the yarn splicing apparatus body block.

7. A yarn slicing apparatus comprising:

a yarn splicing member provided with a yarn splicing hole having a first compressed fluid jetting hole, yarn clamping devices disposed on opposing sides of the yarn splicing member, a yarn cutting device provided between the yarn splicing member and each of the yarn clamping devices, respectively, untwisting nozzle pipes for untwisting the cut yarn ends provided in an untwisting nozzle block to which the yarn splicing member is removably mounted, a yarn splicing apparatus body block on which said untwisting nozzle block and said splicing nozzle member are mounted, wherein said untwisting nozzle block further comprises:

a second compressed fluid jetting hole formed obliquely toward the interior in the untwisting nozzle pipe, a fluid path for supplying compressed fluid to the untwisting nozzle pipes, and a securing means for fitting the untwisting nozzle block to the yarn splicing member and the yarn splicing apparatus body block, wherein a first thin pipe which supplies a compressed fluid to the second compressed fluid jetting hole is further provided in the untwisting nozzle block and one end of the first thin pipe protrudes from a coupling face of the untwisting nozzle block with the yarn splicing apparatus body block, said first thin pipe being a fluid path between the untwisting nozzle pipes and a compressed fluid supply path provided in the yarn splicing apparatus body block and being used as a positioning member for mounting the untwisting nozzle block on the yarn splicing apparatus body block.

8. A yarn apparatus comprising:

a yarn splicing member provided with a yarn splicing hole having a first compressed fluid jetting hole, yarn clamping devices disposed on opposing sides of the yarn splicing member, a yarn cutting device provided between the yarn splicing member and each of the yarn clamping devices, respectively, untwisting nozzle pipes for untwisting the cut yarn ends provided in an untwisting nozzle block to which the yarn splicing member is removably mounted, a yarn splicing apparatus body block on which said untwisting nozzle block and said splicing nozzle member are mounted, wherein said untwisting nozzle further comprises:

a second compressed fluid jetting hole formed obliquely toward the interior in the untwisting nozzle pipe, a fluid path for supplying compressed fluid to the untwisting nozzle pipes, and a securing means for fitting the untwisting nozzle block to the yarn splicing member and the yarn slicing apparatus body block, wherein a second thin pipe which is disposed through the untwisting nozzle block and protrudes from a coupling face of the untwisting nozzle block with the yarn slicing member is further provided to be a compressed fluid supply path communicating with the first compressed fluid jetting hole of the yarn splicing member and to be used as a positioning member for mounting the yarn splicing member on the yarn untwisting nozzle block.

9. A yarn splicing apparatus comprising:

a yarn splicing member provided with a yarn splicing hole, an untwisting nozzle block having at least one untwisting nozzle integrally associated therewith, a yarn splicing apparatus body block, means for coupling said yarn splicing member and said untwisting nozzle block, means for coupling said untwisting nozzle block and said yarn splicing apparatus body block, whereby said untwisting nozzle may be removed from said yarn slicing apparatus independent of said yarn splicing member.

* * * * *